US011982496B2

(12) United States Patent
Nielsen

(10) Patent No.: US 11,982,496 B2
(45) Date of Patent: May 14, 2024

(54) PLATE KIND HEAT EXCHANGER WITH SEALED INLET CHANNEL

(71) Applicant: Danfoss A/S, Nordborg (DK)

(72) Inventor: Helge Nielsen, Sydals (DK)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 17/752,929

(22) Filed: May 25, 2022

(65) Prior Publication Data

US 2022/0381518 A1 Dec. 1, 2022

(30) Foreign Application Priority Data

May 27, 2021 (DK) ..... PA202100562

(51) Int. Cl.

| | |
|---|---|
| ***F28D 9/00*** | (2006.01) |
| ***F28F 3/10*** | (2006.01) |
| *F28D 21/00* | (2006.01) |

(52) U.S. Cl.

CPC ..... *F28D 9/005* (2013.01); *F28F 3/10* (2013.01); *F28D 2021/0071* (2013.01); *F28F 2230/00* (2013.01); *F28F 2275/14* (2013.01)

(58) Field of Classification Search

CPC . F28D 9/00; F28D 9/026; F28D 9/005; F28D 2021/0071; F28F 9/026; F28F 3/10; (Continued)

(56) References Cited

U.S. PATENT DOCUMENTS

| | | | |
|---|---|---|---|
| 10,024,602 B2 | 7/2018 | Nyander et al. | |
| 2008/0196874 A1* | 8/2008 | Bertilsson | F28D 9/005 165/167 |

(Continued)

FOREIGN PATENT DOCUMENTS

| | | | |
|---|---|---|---|
| DE | 4303669 C1 * | 1/1994 | F28F 3/10 |

OTHER PUBLICATIONS

Extended European Search Report corresponding to European Patent Application Serial No. 22166465.9 dated Sep. 16, 2022.

*Primary Examiner* — Harry E Arant

(74) *Attorney, Agent, or Firm* — McCormick, Paulding & Huber PLLC

(57) ABSTRACT

A plate kind heat exchanger (1) has a plurality of stacked plates (2) forming flow paths for heat exchanging fluids there between, a first inlet channel being fluidly connected to inlets of a first set of flow paths, a second inlet channel being fluidly connected to inlets of a second set of flow paths, a first outlet channel being fluidly connected to outlets of the first set of flow paths, and a second outlet channel being fluidly connected to outlets of the second set of flow paths. The first inlet channel is provided with a stack (15) of rings (5) forming fluid passages towards the inlets of the first set of flow paths. Each ring (5) has a first rigid shell member (6) and a second rigid shell member (7), the first rigid shell member (6) and/or the second rigid shell member (7) defining a groove (9) providing fluid passage from the first inlet channel to one of the flow paths of the first set of flow paths, and a sealing member (8) formed from a compressible material, the sealing member (8) being positioned between the first rigid shell member (6) and the second rigid shell member (7). The stack of rings (15) is subjected to a force which presses the rings (5) towards each other and compresses the sealing members (8) of the rings (5), thereby providing sealing towards the flow paths of the second set of flow paths.

18 Claims, 6 Drawing Sheets

(58) Field of Classification Search
CPC ..... F28F 2230/00; F28F 9/0282; F28F 9/028; F28F 9/0273; F28F 2275/14; F28F 3/086; F28F 3/08; F28F 9/22
See application file for complete search history.

(56) References Cited

U.S. PATENT DOCUMENTS

| | | | |
|---|---|---|---|
| 2016/0356560 | A1 | 12/2016 | Wei et al. |
| 2019/0145711 | A1 | 5/2019 | Mohammadian et al. |

* cited by examiner

PLATE KIND HEAT EXCHANGER WITH SEALED INLET CHANNEL

CROSS-REFERENCE TO RELATED APPLICATION

This application claims foreign priority benefits under U.S.C. § 119 from Danish Patent Application No. PA202100562, filed May 27, 2021, the content of which is hereby incorporated by reference in its entirety.

TECHNICAL FIELD

The present invention relates to a plate kind heat exchanger, i.e. a heat exchanger comprising a plurality of stacked plates forming flow paths for heat exchanging fluids there between. The plate kind heat exchanger of the invention has a first inlet channel which is provided with a stack of rings providing sealing towards some of the flow paths. The invention further relates to a ring for such a plate kind heat exchanger and a method for manufacturing such a plate kind heat exchanger.

BACKGROUND

Plate kind heat exchangers are often used as evaporators in vapour compression systems, such as refrigeration systems or heat pumps. Such vapour compression systems normally comprise one or more compressors, a heat rejecting heat exchanger, and expansion device, e.g. in the form of an expansion valve, and an evaporator arranged in a refrigerant path. Refrigerant flowing in the refrigerant path is alternatingly compressed by the compressor(s) and expanded by the expansion device, while heat exchange takes place in the heat rejecting heat exchanger and the evaporator, in such manner that heat is rejected from the refrigerant flowing through the heat rejecting heat exchanger and heat is absorbed by the refrigerant flowing through the evaporator.

Thus, when refrigerant flows through the evaporator, heat exchange takes place between the refrigerant and a secondary fluid, in such a manner that heat is transferred from the secondary fluid to the refrigerant. Accordingly, the refrigerant forms the cold side of the heat exchanger and the secondary fluid forms the hot side of the heat exchanger.

As described above, the evaporator may be in the form of a plate kind heat exchanger, i.e. a heat exchanger comprising a plurality of stacked plates forming flow paths there between. Heat exchanging fluids thereby flow along opposing sides of a given plate, and heat exchange between the fluids takes place through the plate. The plate kind heat exchanger comprises two inlet channels and two outlet channels, one inlet channel and one outlet channel for each of the heat exchanging fluids. The respective inlet channels and outlet channels are fluidly connected to flow paths which are to receive the respective fluids, and should be sealed against the flow paths in which the other heat exchanging fluid flows, in order to keep the heat exchanging fluids separate from each other.

One problem which may arise when using plate kind heat exchangers as evaporators is that refrigerant entering the heat exchanger is not evenly distributed among the flow paths defined between the plates. This is partly due to the fact that, after having passed through the expansion device, the refrigerant is already partly evaporated. Therefore, the refrigerant tends to separate into streams of liquid and vapour, respectively, when passing through the inlet channel, and thereby the refrigerant supplied from the inlet channel to the respective flow paths does not contain a homogeneous distribution of liquid and vapour. Such uneven distribution of refrigerant among the flow paths results in inefficient use of parts of the plate kind heat exchanger. Furthermore, this may result in an increased superheat of the refrigerant leaving some of the flow paths of the evaporator, which also indicates inefficient use of the capacity of the evaporator. Finally, some of the flow paths may be flooded, introducing a risk that liquid refrigerant reaches the compressor(s), thereby risking damage to the compressor(s).

It has previously been attempted to address the problems regarding uneven distribution of refrigerant among flow paths of a plate kind heat exchanger used as an evaporator. Thus, US 2008/0196874 A1 discloses a plate heat exchanger having a package of heat transfer plates, which are provided with through inlet ports forming an inlet channel through the package, and between the heat transfer plates arranged sealing means, which together with the heat transfer plates in every other plate interspace delimit a first flow passage for one fluid and in each of the remaining plate interspaces delimit a second flow passage for a second fluid. The inlet channel communicates with each first flow passage by way of a first inlet passage, and is sealed form communication with each second flow passage by a sealing means. The sealing means may, e.g., be in the form of a ring which has been inserted between two adjacent transfer plates around a port.

SUMMARY

It is an object of embodiments of the invention to provide a plate kind heat exchanger in which the sealing of the inlet channel is improved.

According to a first aspect the invention provides a plate kind heat exchanger comprising a plurality of stacked plates forming flow paths for heat exchanging fluids there between, the plate kind heat exchanger comprising a first inlet channel being fluidly connected to inlets of a first set of flow paths, a second inlet channel being fluidly connected to inlets of a second set of flow paths, a first outlet channel being fluidly connected to outlets of the first set of flow paths, and a second outlet channel being fluidly connected to outlets of the second set of flow paths, wherein the first inlet channel is provided with a stack of rings forming fluid passages towards the inlets of the first set of flow paths, wherein each ring comprises:

- a first rigid shell member and a second rigid shell member, the first rigid shell member and/or the second rigid shell member defining a groove providing fluid passage from the first inlet channel to one of the flow paths of the first set of flow paths,
- a sealing member formed from a compressible material, the sealing member being positioned between the first rigid shell member and the second rigid shell member, wherein the stack of rings is subjected to a force which presses the rings towards each other and compresses the sealing members of the rings, thereby providing sealing towards the flow paths of the second set of flow paths.

Thus, according to the first aspect, the invention provides a plate kind heat exchanger, i.e. a heat exchanger comprising a plurality of stacked plates forming flow paths for heat exchanging fluids there between.

The plate kind heat exchanger comprises a first inlet channel, a second inlet channel, a first outlet channel and a second outlet channel. The first inlet channel is fluidly connected to inlets of a first set of flow paths, and the first outlet channel is fluidly connected to outlets of the first set of flow paths. Thus, a first heat exchanging fluid which is supplied to the first inlet channel is distributed among the flow paths of the first set of flow paths, via their respective inlets. The fluid then passes along these flow paths and leaves the flow paths and enters the first outlet channel.

Similarly, the second inlet channel is fluidly connected to inlets of a second set of flow paths, and the second outlet channel is fluidly connected to outlets of the second set of flow paths. Thus, a second heat exchanging fluid which is supplied to the second inlet channel is distributed among the flow channels of the second set of flow channels, flows there through, and is collected at the second outlet channel, similarly to the situation described above with reference to the first heat exchanging fluid.

Accordingly, the first heat exchanging fluid and the second heat exchanging fluid pass through the heat exchanger via the first and second set of flow paths, respectively. The first set of flow paths are separate from the second set of flow paths, and thereby the first heat exchanging fluid remains separated from the second heat exchanging fluid. However, the first set of the flow paths are arranged alternatingly with the second set of flow paths, in the sense that, for a given plate, a flow path of the first set of flow paths is defined along a first surface of the plate, and a flow path of the second set of flow paths is defined along a second, opposite, surface of the plate. Thereby heat exchange takes place between the first heat exchanging fluid, flowing along the first surface of the plate, and the second heat exchanging fluid, flowing along the second, opposite, surface of the plate, through the plate.

The first inlet channel is provided with a stack of rings forming fluid passages towards the inlets of the first set of flow paths. Accordingly, the stack of rings, in particular the fluid passages formed by the stack of rings, defines how the first heat exchanging fluid is supplied to the flow paths of the first set of flow paths, including the distribution of heat exchanging fluid among the flow paths.

Each ring of the stack of rings comprises a first rigid shell member, a second rigid shell member and a sealing member. The first rigid shell member and/or the second rigid shell member defines a groove which provides fluid passage from the first inlet channel to one of the flow paths of the first set of flow paths. Accordingly, the fluid passages towards the flow passages of the first set of flow passages are provided by a structural design of the first rigid shell member and/or the second rigid shell member. In the present context the term 'rigid shell member' should be interpreted to mean a member which is formed from a rigid material, i.e. a material which is non-compressible, and which preserves its shape. Thereby the fluid passages towards the flow paths of the first set of flow paths are well defined.

The sealing member is formed from a compressible material, and it is positioned between the first rigid shell member and the second rigid shell member. Accordingly, if a force is applied to the ring, which presses the first rigid shell member and the second rigid shell member towards each other, the rigid shell members will maintain their shape, and the sealing member positioned there between will be compressed.

In the plate kind heat exchanger according to the invention, the stack of rings is mounted in the first inlet channel in a manner which ensures that, as long as the stack of rings are positioned in the first inlet channel, the stack of rings is continuously subjected to a force which presses the rings towards each other and compresses the sealing members of the rings. Thereby the compressed sealing members provide sealing towards the flow paths of the second set of flow paths. Accordingly, it is efficiently ensured that the first heat exchanging fluid and the second heat exchanging fluid remain separated.

Since the sealing is provided by the compressed, and thereby deformed, sealing members, each arranged between two rigid shell members, deformation of the rigid shell members is prevented, e.g. when the stacked plates of the plate kind heat exchanger are pressed together. Thereby the stack of rings preserves its shape, and the fluid passages towards the flow paths of the first set of flow paths remain well defined, while efficient sealing towards the flow paths of the second set of flow paths is ensured.

The first rigid shell members and/or the second rigid shell members of the rings may be provided with one or more cut-outs allowing a portion of the respective sealing member to protrude through the rigid shell member, thereby positioning the sealing member in sealing abutment with a rigid shell member of an adjacent ring.

According to this embodiment, sealing is not only provided between a sealing member and the rigid shell members of a given ring of the stack of rings, i.e. within the given ring. Since a portion of the sealing member protrudes through at least one of the rigid shell member, this portion abuts a rigid shell member of an adjacent ring of the stack of rings, and thereby sealing is provided between rings arranged adjacent to each other in the stack of rings. This even further ensures efficient sealing towards the flow paths of the second set of flow paths.

The first rigid shell members and/or the second rigid shell members may be provided with one or more protruding parts arranged to push the portion of the respective sealing member through a cut-out formed in a corresponding second/first rigid shell member. According to this embodiment, it is ensured that the portion of the sealing member is automatically and efficiently pushed through the cut-out and into abutment with a rigid shell part of an adjacent ring, when the stack of rings is assembled and compressed.

The first rigid shell member may be identical to the second rigid shell member. This allows the same tool, e.g. a stamping tool or a mould, to be applied for manufacturing the first rigid shell member and the second rigid shell member, thereby significantly reducing the manufacturing costs.

The sealing members may be provided with protruding parts arranged in engagement with corresponding recesses formed in the stacked plates, thereby fixating each ring relative to a plate.

According to this embodiment, the cooperation between the protruding parts of the sealing members and the corresponding recesses of the stacked plates prevents the stack of rings from rotating relative to the stacked plates, and thereby relative to the first inlet channel. This ensures an accurate positioning of the stack of rings in the first inlet channel, and thereby relative to the inlets of the flow paths of the first set of flow paths, and that the stack of rings remains in position during operation of the plate kind heat exchanger. Furthermore, since the protruding parts are formed on the sealing members, sealing is provided between the stack of rings and the stacked plates. The protruding parts may protrude along a radial direction of the rings.

The first rigid shell members and the second rigid shell members may be made from the same material as the stacked plates. According to this embodiment, it is ensured that the rigid shell members react in the same manner as the stacked plates during operation of the plate kind heat exchanger, e.g. with regard to changes in pressure, temperature, etc. Thereby the risk that the relative positions of the flow passages provided by the grooves of the rigid shell members and the inlets of the flow passages of the first set of flow paths are shifted during operation of the plate kind heat exchanger is minimised.

Furthermore, manufacturing the rigid shell members from the same material as the stacked plates allows these parts to be manufactured from one piece of plate material, possibly in a single working step.

The applied material may be a metal, such as aluminium, stainless steel, or any other suitable kind of metal. The plates and/or the rigid shell members may be coated with a corrosion resistant material.

The first inlet channel may be connectable to a fluid supply of a fluid forming the cold side of the plate kind heat exchanger.

According to this embodiment, the first heat exchanging fluid, i.e. the fluid flowing through the first set of flow paths, forms the cold side of the plate kind heat exchanger. Thus, when heat exchange takes place between the first heat exchanging fluid and the second heat exchanging fluid, heat is absorbed by the first heat exchanging fluid, i.e. heat is transferred from the second heat exchanging fluid to the first heat exchanging fluid.

The plate kind heat exchanger may be or form part of an evaporator, such as an evaporator in a vapour compression system. In this case the first heat exchanging fluid may be a refrigerant, and the fluid supply may include an expansion device, such as an expansion valve, arranged to control the refrigerant supply to the evaporator. Thereby the stack of rings arranged in the first inlet channel ensures accurate refrigerant supply to the flow paths and an appropriate distribution of refrigerant among the flow paths, as well as efficient sealing the first inlet channel.

According to a second aspect the invention provides a ring for a plate kind heat exchanger according to the first aspect of the invention, the ring comprising:

- a first rigid shell member and a second rigid shell member, the first rigid shell member and/or the second rigid shell member defining a groove providing a fluid passage,
- a sealing member formed from a compressible material, the sealing member being positioned between the first rigid shell member and the second rigid shell member, thereby providing sealing.

It is submitted that a person skilled in the art would readily recognise that any feature disclosed in combination with the first aspect of the invention could also be combined with the second aspect of the invention, and vice versa. Accordingly, the remarks set forth above with reference to the first aspect of the invention are equally applicable here. In particular, the ring according to the second aspect of the invention has already been described in detail above with reference to the first aspect of the invention.

The first rigid shell member and/or the second rigid shell member may be provided with one or more cut-outs allowing a portion of the sealing member to protrude through the rigid shell member, thereby allowing the sealing member to be arranged in sealing abutment with a rigid shell member of an adjacent ring. This has already been described in detail above with reference to the first aspect of the invention.

The first rigid shell member and/or the second rigid shell member may be provided with one or more protruding parts arranged to push the portion of the sealing member through a cut-out formed in the second/first rigid shell member. This has already been described in detail above with reference to the first aspect of the invention.

The first rigid shell member may be identical to the second rigid shell member. This has already been described in detail above with reference to the first aspect of the invention.

The sealing member may be provided with protruding parts configured to be arranged in engagement with corresponding recesses formed in a plate of a plate kind heat exchanger. This has already been described in detail above with reference to the first aspect of the invention.

According to a third aspect the invention provides a method for manufacturing a plate kind heat exchanger according to the first aspect of the invention, the method comprising the steps of:

- providing a plurality of plates,
- forming a plurality of rings by, for each ring:
  - providing a first rigid shell member, a second rigid shell member, and a sealing member made from a compressible material, the first rigid shell member and/or the second rigid shell member defining a groove, and
  - arranging the sealing member between the first rigid shell member and the second rigid shell member,
- forming a stack of the plurality of plates, thereby forming flow paths between the plates, and forming a stack of the plurality of rings, the stack of rings being arranged in an inlet channel formed in the stack of plates, and
- pressing the rings towards each other, thereby compressing the sealing members and providing sealing towards a second set of flow paths formed between the plates.

Thus, the third aspect of the invention provides a method for manufacturing a plate kind heat exchanger according to the first aspect of the invention. A person skilled in the art would therefore readily recognise that any feature described in combination with the first aspect could also be combined with the third aspect of the invention, and vice versa.

In the method according to the third aspect of the invention, a plurality of plates are initially provided. Furthermore, a plurality of rings are formed, where each ring is formed in the following manner.

A first rigid shell member, a second rigid shell member and a sealing member made form a compressible material are provided, in the manner described above with reference to the first aspect of the invention, i.e. the first rigid shell member and/or the second rigid shell member define(s) a groove. The sealing member is arranged between the first rigid shell member and the second rigid shell member, thereby forming a ring with the sealing member sandwiched between the two rigid shell members.

Next, a stack of the plurality of plates and a stack of the plurality of rings are formed. Thereby flow paths are formed between the plates, as described above with reference to the first aspect of the invention. The stack of rings is arranged in an inlet channel formed in the stack of plates. This may be done by forming the stack of plates and the stack of rings separately, and subsequently arranging the stack of rings in the inlet channel formed in the stack of plates. Alternatively, each ring may be mounted on a plate, and the stack of rings may be formed simultaneously with, and as a part of the process of forming the stack of plates.

Finally, the rings are pressed towards each other, thereby compressing the sealing members and providing sealing towards a second set of flow paths formed between the plates, in the manner described above with reference to the first aspect of the invention.

The step of providing a plurality of plates may comprise, for each plate, punching one or more through-going holes in the plate, wherein the through-going holes in the plates form inlet channels and/or outlet channels of the plate kind heat exchanger when the plates are stacked, and the step of providing a first rigid shell member and/or the step of providing a second rigid shell member may be performed as part of punching the one or more through-going holes in the plates.

According to this embodiment, the plates are formed by means of a punching process, where one or more through-going holes are formed in each plate. When the plates are stacked, corresponding through-going holes of the respective plates are arranged overlappingly, thereby forming inlet channels and/or outlet channels of the plate kind heat exchanger.

Thus, when the through-going holes are formed in the plates, material is removed, and this removed material would normally be discarded. However, according to this embodiment, part of this removed material is used for forming the first rigid shell member and/or the second rigid shell member, thereby reducing waste. Furthermore, since the through-going holes of the plates and the rigid shell members of the rings are formed in the same punching step, the manufacturing process is fast and efficient.

The method may further comprise the step of restraining the stack of rings after compressing the sealing members, thereby maintaining the sealing members in a compressed state and maintaining the sealing towards the second set of flow paths.

According to this embodiment, it is ensured that the sealing members remain in the compressed state, thereby providing efficient sealing towards the flow paths of the second set of flow paths during operation of the plate kind heat exchanger. Thus, the compressed sealing members are prevented from restoring their original shape.

The stack of rings may, e.g., be restrained in the same manner as the stack of plates are restrained in order to form the plate kind heat exchanger. For instance, end plates of the stack of plates and/or pipe connections connected thereto may be fixated relative to each other in such a manner that the plates of the stack of plates as well as the rings of the stack for rings are kept tightly together. Thereby the stack of plates may be confined between such end positions.

BRIEF DESCRIPTION OF THE DRAWINGS

The invention will now be described in further detail with reference to the accompanying drawings in which.

DETAILED DESCRIPTION

Figure 1:
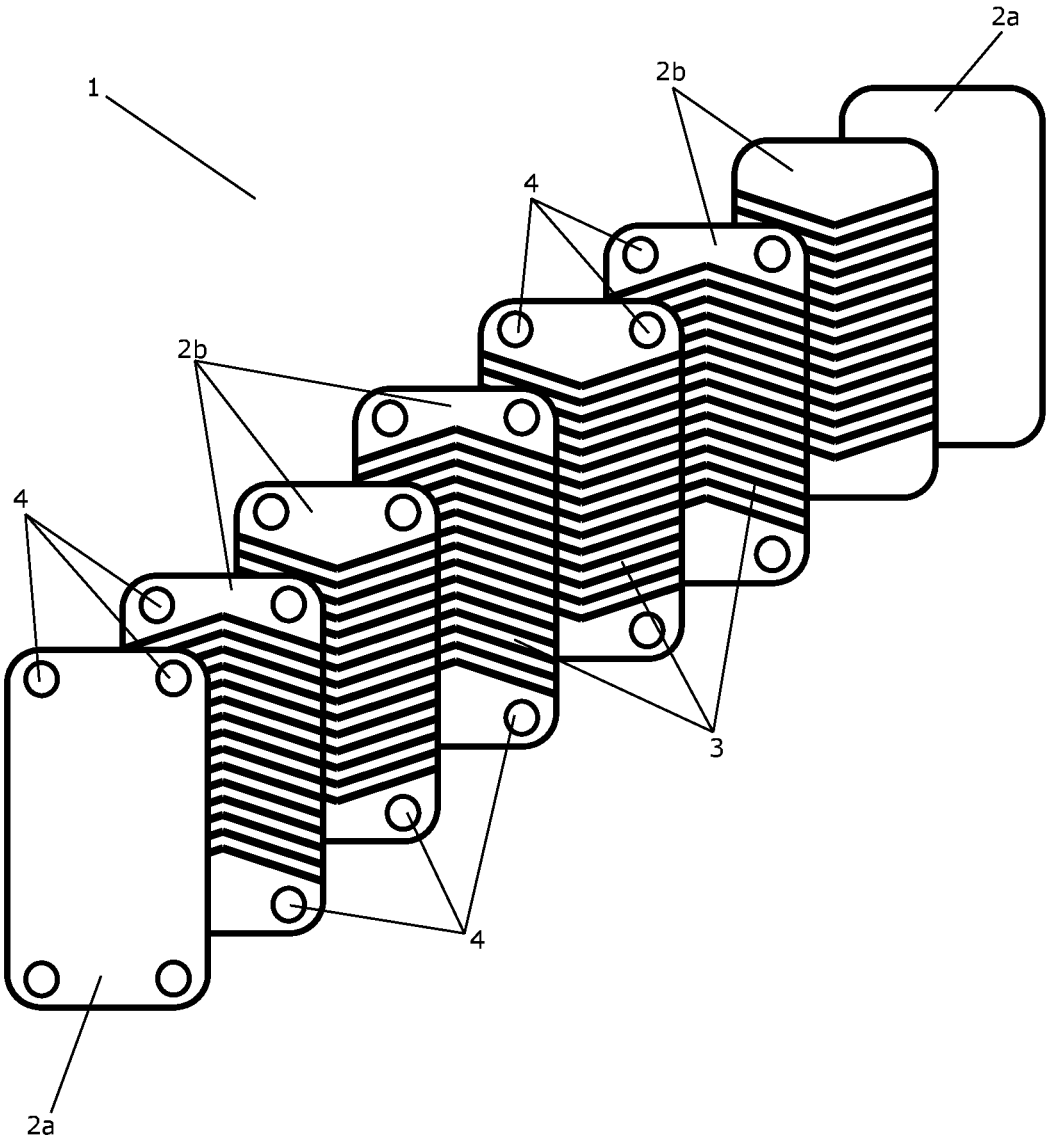
FIG. 1 is an exploded view of a plate kind heat exchanger according to an embodiment of the invention.

FIG. 1 is an exploded view of a plate kind heat exchanger 1 according to an embodiment of the invention. The plate kind heat exchanger 1 comprises a plurality of plates 2, including two cover plates 2*a* and six intermediate plates 2*b*, each being provided with a plurality of corrugations 3 arranged in a herring bone pattern. When the plates 2 are stacked in order to form the plate kind heat exchanger, flow paths are formed between the plates 2 by means of the corrugations 3.

The plates 2 are each provided with four through-going holes 4. When the plates 2 are stacked, the through-going holes 4 are of the respective plates 2 are arranged adjacent to each other, thereby forming two inlet channels and two outlet channels. A first inlet channel and a first outlet channel are fluidly connected to a first set of flow paths formed by the corrugations 3, in such a manner that a first heat exchanging fluid can enter the flow paths of the first set of flow paths from the first inlet channel, and leave the flow paths of the first set of flow paths via the first outlet channel.

Similarly, a second inlet channel and a second outlet channel are fluidly connected to a second set of flow paths formed by the corrugations 3, in such a manner that a second heat exchanging fluid can enter the flow paths of the second set of flow paths from the second inlet channel, and leave the flow paths of the second set of flow paths via the second outlet channel.

The first set of flow paths and the second set of flow paths are arranged alternatingly, in the sense that, for a given plate 2, a flow path of the first set of flow paths is defined along one surface of the plate 2, and a flow path of the second set of flow paths is defined along another, opposite, surface of the plate 2. Thereby heat exchange takes place between the first heat exchanging fluid and the second heat exchanging fluid through the plate 2.

At least the first inlet channel is provided with a stack of rings (not shown). The stack of rings form fluid passages towards the flow paths of the first set of flow paths, and provides sealing towards the flow paths of the second set of flow paths. This will be described in further detail below with reference to FIGS. 2-6.

Figure 2:
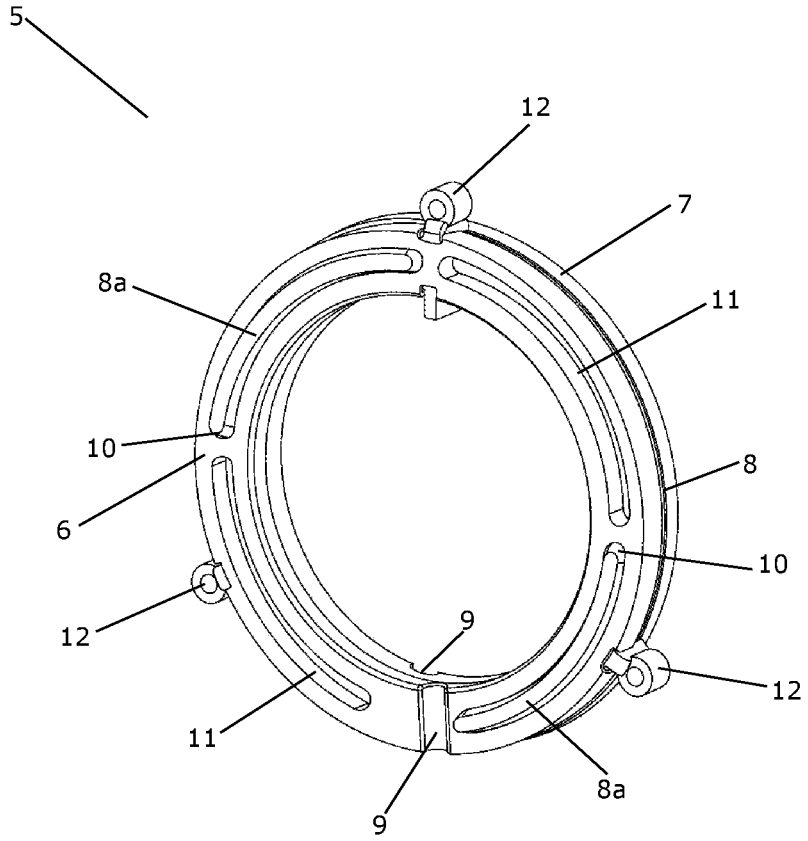
FIG. 2 is a perspective view of a ring according to an embodiment of the invention.

FIG. 2 is a perspective view of a ring 5 according to an embodiment of the invention. The ring 5 is configured to form part of a stack of rings to be mounted in an inlet channel of a plate kind heat exchanger according to an embodiment of the invention.

The ring 5 comprises a first rigid shell member 6, a second rigid shell member 7 and a sealing member 8 positioned between the first rigid shell member 6 and the second rigid shell member 7. The sealing member 8 is formed from a compressible material, whereas the rigid shell members 6, 7 are formed from an essentially non-compressible material. Thereby, when the first rigid shell member 6 and the second rigid shell member 7 are pushed towards each other, the rigid shell members 6, 7 maintain their shape, while the sealing member 8 is compressed, and thereby deformed, and thereby provides sealing between the first rigid shell member 6 and the second rigid shell member 7.

The first rigid shell member 6 and the second rigid shell member 7 are each provided with a groove 9 which provides fluid passage between an inner circumference of the ring 5 and an outer circumference of the ring 5. Accordingly, fluid passage is provided from the interior of the ring 5, forming an inner lining of the inlet channel, towards selected flow paths, via the grooves 9. Since the grooves 9 are formed in the rigid shell parts 6, 7, their size and shape are maintained when the rigid shell parts 6, 7 are pushed towards each other and the sealing member 8 is compressed. This ensures a well defined fluid flow from the inlet channel towards the flow paths.

The first rigid shell member 6 is provided with two cut-outs 10, each allowing a portion 8*a* of the sealing member 8 to protrude through the first rigid shell member 6. Thereby, when the ring 5 is positioned in abutment with another ring, in order to form a stack of rings, the protruding portion 8*a* of the sealing member 8 abuts a rigid shell member of the adjacent ring, thereby providing sealing between the rings of the stack.

The first rigid shell member 6 is further provided with two recesses 11, each forming a protruding part towards the sealing member 8. These protruding parts push portions of the sealing member 8 through cut-outs formed in the second rigid shell part 7, similar to the portions 8*a* protruding through the cut-outs 10 formed in the first rigid shell member 6. Furthermore, the recesses 11 are arranged to receive protruding parts of a sealing member of an adjacent ring.

The sealing member 8 is provided with three protruding parts 12, each protruding from the sealing member 8 in a radial direction. The protruding parts 12 are configured to be arranged in engagement with corresponding recesses formed in a plate forming part of a stack of plates of a plate kind heat exchanger. Thereby the ring 5 is prevented from performing rotating movements relative to the plate. Accordingly, the grooves 9 remain in a fixed position relative to inlets of the relevant flow paths, and an accurate fluid flow towards the flow paths is ensured.

Figure 3:
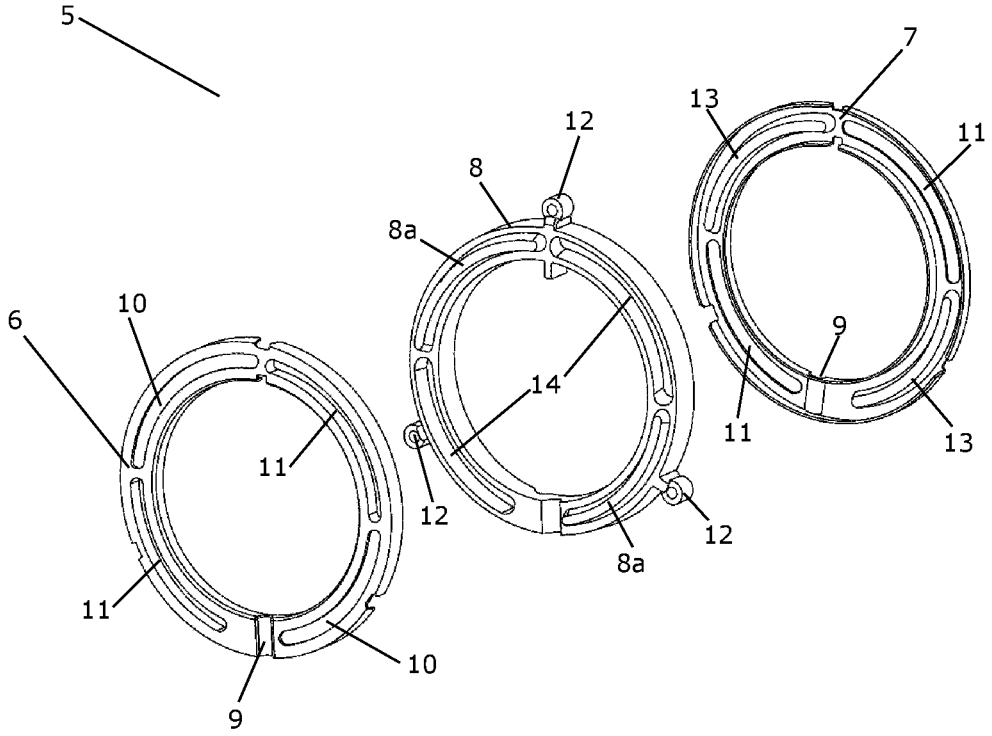
FIG. 3 is an exploded view of the ring of FIG. 2.

FIG. 3 is an exploded view of the ring 5 of FIG. 2. Thus, details of the first rigid shell member 6, the second rigid shell member 7 and the sealing member 8 are clearly visible.

It can be seen that the first rigid shell member 6 and the second rigid shell member 7 are identical, the second rigid shell member 7 being rotated 180° relative to the first rigid shell member 7, thereby positioning the cut-outs 10 of the second rigid shell member 7 overlappingly with the recesses 11 of the first rigid shell member 6, and vice versa. It can further be seen that the recesses 11 result in protruding parts 13 of the second rigid shell member, and that these will push the portions 8*a* of the sealing member 8 through the cut-outs 10 of the first rigid shell member 6 when the ring 5 is assembled.

It can further be seen that the protruding portions 8*a* are formed on the sealing member 8, and that corresponding recesses 14 arranged to receive protruding parts 13 of the rigid shell members 6, 7 are formed on sealing member 8, at positions corresponding to the protruding portions 8*a*, but on an opposite side of the sealing member 8.

Figure 4:
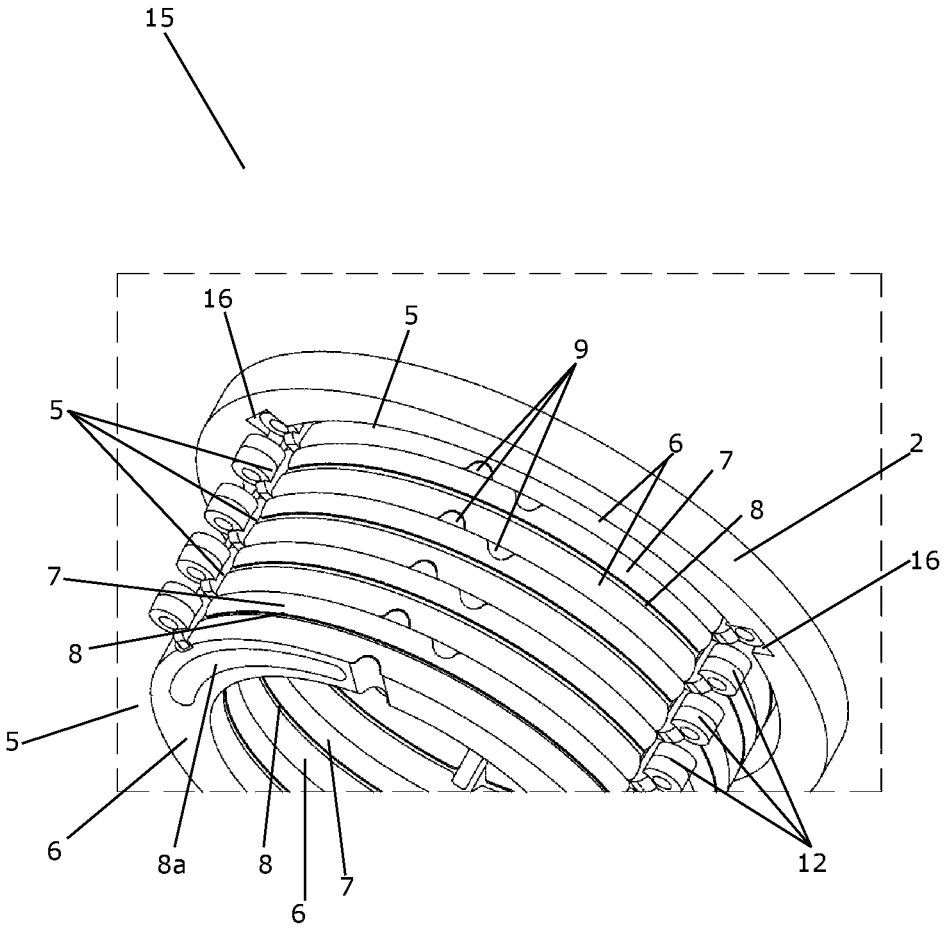
FIG. 4 is a perspective view of a stack of rings according to an embodiment of the invention.

FIG. 4 is a perspective view of a stack of rings 15 comprising five rings 5 of the kind illustrated in FIGS. 2 and 3. Thus, each ring 5 comprises a first rigid shell member 6, a second rigid shell member 7 and a sealing member 8 arranged there between.

The rings 5 are positioned adjacent to each other, thereby forming the stack of rings 15, in such a manner that a first rigid shell member 6 of one ring 5 is arranged in abutment with a second rigid shell member 7 of an adjacent ring 5. The grooves 9 formed in the rigid shell members 6, 7 provide fluid passages towards flow paths of a first set of flow paths.

A compressing force is applied to the stack of rings 15 along an axial direction, thereby pushing the rigid shell members 6, 7 towards each other and compressing the sealing members 8, in the manner described above. Thereby sealing is provided between the first rigid shell member 6 and the second rigid shell member 7 of each ring 5, but also between the rings 5, due to the protruding portions 8*a* of the sealing members 8 abutting against rigid shell members 6, 7 of adjacent rings 5. Thereby sealing towards flow paths of a second set of flow paths is obtained. The stack of rings 15 is maintained in this compressed state, thereby maintaining the sealing towards the flow paths of the second set of flow paths.

Part of a plate 2 of a plate kind heat exchanger having the stack of rings 15 mounted therein is shown, and it can be seen that the protruding parts 12 formed on the sealing member 8 of one of the rings 5 is arranged in engagement with corresponding recesses 16 formed in the plate 2. Thereby the stack of rings 15 is prevented from rotating relative to the plates 2 of the plate kind heat exchanger, and the grooves 9 remain firmly in fluid contact with inlets of the flow paths of the first set of flow paths.

Figure 5:
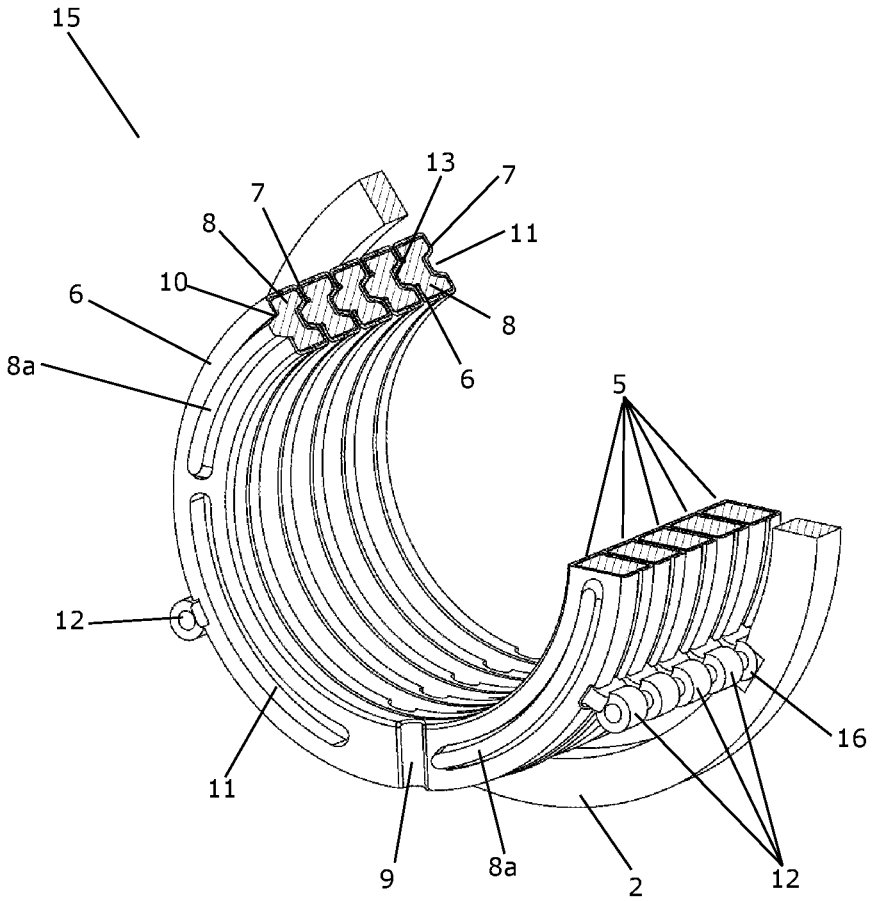
FIG. 5 is a perspective cross sectional view of the stack of rings of FIG. 4.

FIG. 5 is a perspective cross sectional view of the stack of rings 15 of FIG. 4. It can clearly be seen that the protruding parts 13 of the rigid shell members 6, 7 push the protruding portions 8*a* of the sealing members 8 through cut-outs 10 formed in other rigid shell members 6, 7.

Figure 6:
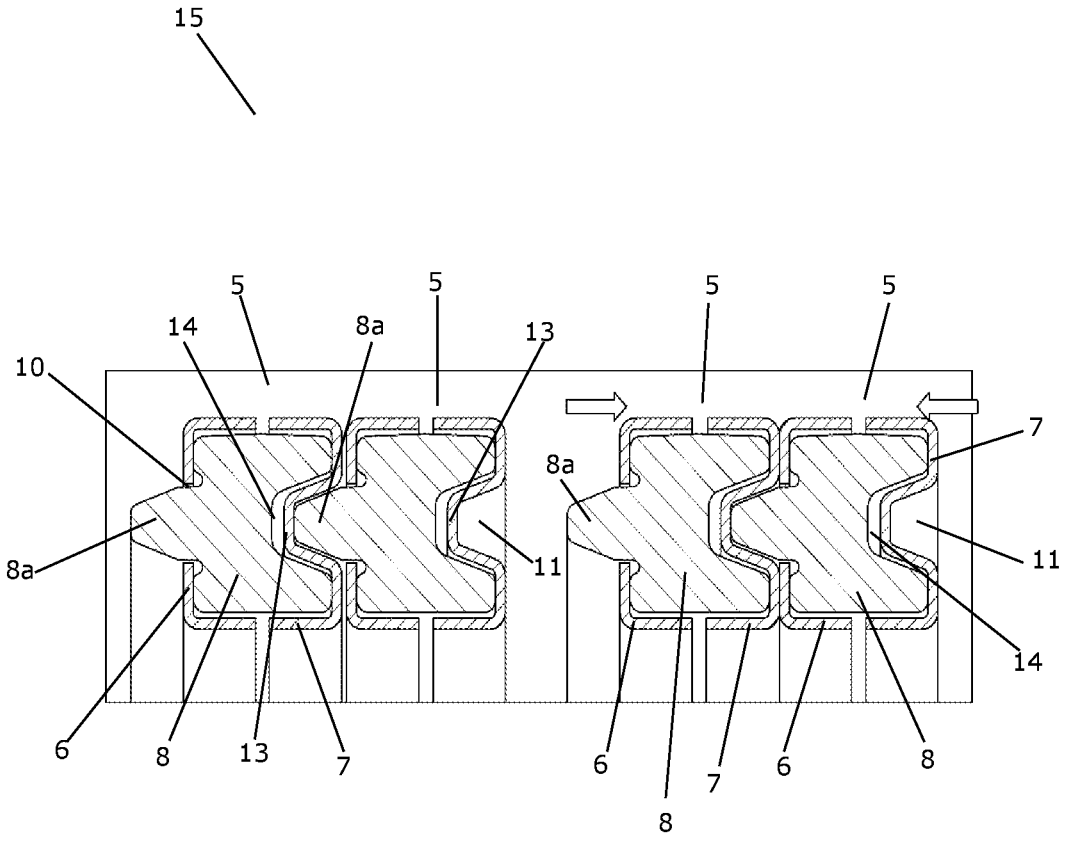
FIG. 6 illustrates assembly of a stack of rings according to an embodiment of the invention.

FIG. 6 illustrates assembly of a stack of rings 15 according to an embodiment of the invention. The rings 5 are of the kind illustrated in FIGS. 2-5, i.e. each ring 5 comprises a first rigid shell member 6, a second rigid shell member 7 and a sealing member 8 arranged there between.

The rings 5 are arranged adjacent to each other, in such a manner that protruding portions 8*a* of the sealing members 8 are received in recesses 11 formed in the second rigid shell members 7 of adjacent rings 5. Furthermore, protruding parts 13 of the second rigid shell members 7 are received in recesses 14 formed in the sealing members 8, and push the protruding portions 8*a* through cut-outs 10 in the first rigid shell members 6 and into abutment with the recesses 11 of the second rigid shell members 7 of the adjacent rings 5. Pushing the rings 5 towards each other causes the sealing members 8 to compress, thereby providing sealing in the manner described above with reference to FIGS. 2-5.

For each of the rings 5, the first rigid shell member 6 and the second rigid shell member 7 are arranged with a small gap there between. This allows the rigid shell members 6, 7 to be moved towards each other, while compressing the sealing member 8 arranged there between, when the stack of rings is subjected to a compressing force during assembly, as described above.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A plate kind heat exchanger comprising a plurality of stacked plates forming flow paths for heat exchanging fluids there between, the plate kind heat exchanger comprising a first inlet channel being fluidly connected to inlets of a first set of flow paths, a second inlet channel being fluidly connected to inlets of a second set of flow paths, a first outlet channel being fluidly connected to outlets of the first set of flow paths, and a second outlet channel being fluidly connected to outlets of the second set of flow paths, wherein a stack of rings is installed in the first inlet channel, the stack of rings forming fluid passages towards the inlets of the first set of flow paths, wherein each ring comprises:

a first rigid shell member and a second rigid shell member, the first rigid shell member and/or the second rigid shell member defining a groove providing fluid passage from the first inlet channel to at least one of the flow paths of the first set of flow paths, a sealing member formed from a compressible material, the sealing member being positioned between the first rigid shell member and the second rigid shell member, wherein the stack of rings is subjected to a force which presses the rings towards each other and compresses the sealing members of the rings, thereby providing sealing towards the flow paths of the second set of flow paths, and wherein the rigid shell members and the plates are provided as separate components.

2. The plate kind heat exchanger according to claim 1, wherein the first rigid shell members and/or the second rigid shell members of the rings are provided with one or more cut-outs allowing a portion of the respective sealing member to protrude through the rigid shell member, thereby positioning the protruding portion of the respective sealing member in sealing abutment with a rigid shell member of an adjacent ring.

3. The plate kind heat exchanger according to claim 1, wherein the first rigid shell members and/or the second rigid shell members are provided with one or more protruding parts arranged to push a portion of the respective sealing member through a cut-out formed in a corresponding second/first rigid shell member.

4. The plate kind heat exchanger according to claim 1, wherein the first rigid shell member is identical to the second rigid shell member.

5. The plate kind heat exchanger according to claim 1, wherein the sealing members are provided with radially protruding parts arranged in engagement with corresponding recesses formed in the stacked plates, thereby fixating each ring relative to a plate.

6. The plate kind heat exchanger according to claim 1, wherein the first rigid shell members and the second rigid shell members are made from the same material as the stacked plates.

7. The plate kind heat exchanger according to claim 1, wherein the first inlet channel is connectable to a fluid supply of a fluid forming the cold side of the plate kind heat exchanger.

8. The plate kind heat exchanger according to claim 1, wherein the plate kind heat exchanger is or forms part of an evaporator.

9. The plate kind heat exchanger according to claim 1, wherein the rigid shell members are formed from material removed from the plates during the formation of the inlet and/or outlet channels of the plates.

10. A ring for a plate kind heat exchanger having a plurality of stacked plates forming flow paths for heat exchanging fluids there between, the plate kind heat exchanger including a first inlet channel being fluidly connected to inlets of a first set of flow paths, a second inlet channel being fluidly connected to inlets of a second set of flow paths, a first outlet channel being fluidly connected to outlets of the first set of flow paths, and a second outlet channel being fluidly connected to outlets of the second set of flow paths, the ring comprising:

a first rigid shell member and a second rigid shell member, the first rigid shell member and/or the second rigid shell member defining a groove providing a fluid passage, and a sealing member formed from a compressible material, the sealing member being positioned between the first rigid shell member and the second rigid shell member, thereby providing sealing, wherein the ring is configured to form part of a stack of rings, the stack of rings to be installed in the first inlet channel and to form fluid passages towards the inlets of the first set of flow paths, and wherein the rigid shell members and the plates are provided as separate components.

11. The ring according to claim 10, wherein the first rigid shell member and/or the second rigid shell member is/are provided with one or more cut-outs allowing a portion of the sealing member to protrude through the rigid shell member, thereby allowing the protruding portion of the sealing member to be arranged in sealing abutment with a rigid shell member of an adjacent ring.

12. The ring according to claim 10, wherein the first rigid shell member and/or the second rigid shell member is/are provided with one or more protruding parts arranged to push a portion of the sealing member through a cut-out formed in the second/first rigid shell member.

13. The ring according to claim 10, wherein the first rigid shell member is identical to the second rigid shell member.

14. The ring according to claim 10, wherein the sealing member is provided with radially protruding parts configured to be arranged in engagement with corresponding recesses formed in a plate of a plate kind heat exchanger.

15. The ring according to claim 10, wherein the rigid shell members are formed from material removed from the plates during the formation of the inlet and/or outlet channels of the plates.

16. A method for manufacturing the plate kind heat exchanger according to claim 1, the method comprising the steps of:

providing a plurality of plates, forming a plurality of rings by, for each ring:

providing a first rigid shell member, a second rigid shell member, and a sealing member made from a compressible material, the first rigid shell member and/or the second rigid shell member defining a groove, wherein the rigid shell members and the plates are provided as separate components, and arranging the sealing member between the first rigid shell member and the second rigid shell member, forming a stack of the plurality of plates, thereby forming flow paths between the plates, and forming a stack of the plurality of rings, the stack of rings being arranged in an inlet channel formed in the stack of plates, and pressing the rings towards each other, thereby compressing the sealing members and providing sealing towards a second set of flow paths formed between the plates.

17. The method according to claim 16, wherein the step of providing a plurality of plates comprises, for each plate, punching one or more through-going holes in the plate, wherein the through-going holes in the plates form inlet channels and/or outlet channels of the plate kind heat exchanger when the plates are stacked, and wherein the step of providing a first rigid shell member and/or the step of providing a second rigid shell member is/are performed as part of punching the one or more through-going holes in the plates.

18. The method according to claim 16, further comprising the step of restraining the stack of rings after compressing the sealing members, thereby maintaining the sealing members in a compressed state and maintaining the sealing towards the second set of flow paths.

* * * * *